US009243811B2

(12) United States Patent
Saito et al.

(10) Patent No.: US 9,243,811 B2
(45) Date of Patent: Jan. 26, 2016

(54) PREDICTED MEAN VOTE ESTIMATING DEVICE AND COMPUTER PROGRAM PRODUCT

(75) Inventors: Masaaki Saito, Tokyo (JP); Yasuo Takagi, Kanagawa (JP); Koichi Ikeda, Kanagawa (JP); Yukio Hiraoka, Tokyo (JP); Kenji Mitsumoto, Kanagawa (JP); Dai Murayama, Tokyo (JP); Nobutaka Nishimura, Tokyo (JP); Yoshikazu Ooba, Tokyo (JP); Yutaka Iino, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 690 days.

(21) Appl. No.: 13/601,191

(22) Filed: Aug. 31, 2012

(65) Prior Publication Data

US 2013/0066585 A1 Mar. 14, 2013

(30) Foreign Application Priority Data

Sep. 9, 2011 (JP) ..... 2011-196984

(51) Int. Cl.

*G01K 3/00* (2006.01)
*G06F 15/00* (2006.01)
*F24F 11/00* (2006.01)

(52) U.S. Cl.

CPC ..... *F24F 11/006* (2013.01); *F24F 11/0012* (2013.01); *F24F 11/0015* (2013.01); *F24F 2011/0036* (2013.01); *F24F 2011/0049* (2013.01); *F24F 2011/0057* (2013.01)

(58) Field of Classification Search

CPC ..... F24F 11/006; F24F 11/0012; F24F 2011/0057; F24F 11/0015; F24F 2011/0036; F24F 2011/0049

USPC ..... 702/134; 236/11, 37, 12.3 C, 91 C; 62/209, 228.4, 229; 703/2, 6

See application file for complete search history.

(56) References Cited

U.S. PATENT DOCUMENTS 5,285,959 A * 2/1994 Nanba et al. ..... 236/11
5,333,953 A * 8/1994 Kon ..... 374/109

(Continued)

FOREIGN PATENT DOCUMENTS

CN 1884934 A 12/2006
JP 62-43588 2/1987

(Continued)

OTHER PUBLICATIONS

International Organization for Standard ("ISO") 7730, Third Edition (Nov. 15, 2005), pp. i-52.

(Continued)

*Primary Examiner* — Carol S Tsai

(74) *Attorney, Agent, or Firm* — Finnegan, Henderson, Farabow, Garrett & Dunner, L.L.P.

(57) ABSTRACT

According to one embodiment, a PMV estimating device calculates a PMV value from an average room radiation temperature, room temperature, room humidity, room air velocity, an amount of cloth worn by a person in the room, and an amount of activity of the person in the room. The PMV estimating device includes: indoor solar radiation calculator; solar radiated article temperature estimator; and average radiation temperature estimator. The indoor solar radiation calculator calculates an amount of solar radiation entered into the room. The solar radiated article temperature estimator estimates a temperature of a solar radiated article receiving the solar radiation entered into the room, by using the amount of solar radiation entered into the room calculated by the indoor solar radiation calculator. The average radiation temperature estimator estimates the average room radiation temperature by using the temperature of the solar radiated article estimated by the solar radiated article temperature estimator.

4 Claims, 13 Drawing Sheets

(56) References Cited

U.S. PATENT DOCUMENTS

| | | | | |
|---|---|---|---|---|
| 5,634,348 | A * | 6/1997 | Ikeda et al. | 62/160 |
| 5,765,383 | A * | 6/1998 | Inoue | 62/209 |
| 6,016,966 | A * | 1/2000 | Inoue | 236/37 |
| 6,042,016 | A * | 3/2000 | Ikeda | 237/12.3 C |
| 6,966,498 | B2 * | 11/2005 | Huang et al. | 236/91 C |
| 7,201,010 | B2 * | 4/2007 | Homan et al. | 62/228.4 |
| 7,206,728 | B2 * | 4/2007 | Ozeki et al. | 703/2 |
| 8,577,650 | B2 * | 11/2013 | Baker et al. | 703/6 |
| 2007/0240437 | A1 | 10/2007 | Yonezawa et al. | |
| 2014/0133406 | A1 * | 5/2014 | Wesby-van Swaay | 370/328 |

FOREIGN PATENT DOCUMENTS

| | | | |
|---|---|---|---|
| JP | 2002-250778 | | 9/2002 |
| JP | 3361017 | | 10/2002 |
| JP | 2003-21688 | | 1/2003 |
| JP | 2008-107910 | | 5/2008 |
| JP | 2008279793 | A * | 11/2008 |
| JP | 2009-47515 | | 3/2009 |
| JP | 4461064 | | 2/2010 |
| JP | 2011-122802 | | 6/2011 |
| JP | 2011-127782 | | 6/2011 |
| JP | 2011-196152 | | 10/2011 |

OTHER PUBLICATIONS

Journal of the Society of Heating, Air-Conditioning and Sanitary Engineers of Japan, Title II, Air-Conditioning Facility, 11$^{th}$ Edition, the Society of Heating, Air-Conditioning and Sanitary Engineers of Japan, p. 68.

Journal of the Society of Heating, Air-Conditioning and Sanitary Engineers of Japan, Title I, Basic, 11$^{th}$ Edition, the Society of Heating, Air-Conditioning and Sanitary Engineers of Japan, p. 171.

Heat Transfer, 3$^{rd}$ Edition, the Japan Society of Mechanical Engineers, p. 300.

Decision of Refusal issued by the Japanese Patent Office on Mar. 10, 2015, for Japanese Patent Application No. 2011-196984, and English-language translation thereof.

* cited by examiner

PREDICTED MEAN VOTE ESTIMATING DEVICE AND COMPUTER PROGRAM PRODUCT

CROSS-REFERENCE TO RELATED APPLICATIONS

This application is based upon and claims the benefit of priority from Japanese Patent Application No. 2011-196984, filed on Sep. 9, 2011, the entire contents of which are incorporated herein by reference.

FIELD

Embodiments described herein relate generally to a predicted mean vote (PMV) estimating device and a computer program product of the PMV estimating device, for estimating a PMV which is a quantitative index for human thermal sensation.

BACKGROUND

Currently, it has been desired to promote energy saving at consumer's end, such as in buildings or houses. Furthermore, due to an influence of the earthquake disaster and tight power demand and supply, a solution for saving more energy (power saving) has been desired. Thus, it has been increasingly important to promote the energy saving at the consumer's end.

Recently, there is a discussion to introduce a "demand-response," which suppresses a power consumption at the consumer's end, in a next generation power system (referred to as the Smart Grid). Here, the next generation power system is realized by establishing a communication environment between the power supplier's end and the power consumer's end. It is considered that, in the future, the energy saving at the consumer's end aiming for overall optimization of the power usage, such as adjustment or systematic stabilization of the power demand and supply, becomes more familiar.

In order to realize increasing the energy saving at the consumer's end, it is necessary to correctly understand environment of a room of the consumer. For example, an energy consumption of air conditioning related devices that maintain environment, such as a room temperature and room humidity, takes up approximately one fourth of the energy consumption of the entire office building. Thus, if excess heating or cooling is recognized and optimized, there is a possibility that large energy saving effect is obtained.

There is known an index referred to as a predicted mean vote (PMV), which is employed as a standard thermal comfort index (standard heat index) of the International Organization for Standard (ISO) 7730. The PMV is an index obtained by obtaining an unbalanced heat with respect to the environment, and by associating the unbalanced heat with thermal sensation. Accordingly, there has been proposed a technique to control air conditioning by using the PMV as a control index for the air conditioning, in order to improve comfort and to increase energy saving by removing the excess cooling and the heating.

However, in the conventional technology, there is no consideration on influence of a temperature change in a solar radiated article that directly receives solar radiation. Here, the solar radiated article is, for example a blind for blocking solar radiation from entering into a room via a window. Thus, the PMV estimated by the conventional technique might be different from that of the actual environment. If such PMV is used as the control index for the air conditioning or the like, there is a possibility that a predicted room environment of the air conditioning or an energy saving effect cannot be obtained.

BRIEF DESCRIPTION OF THE DRAWINGS

A general architecture that implements the various features of the invention will now be described with reference to the drawings. The drawings and the associated descriptions are provided to illustrate embodiments of the invention and not to limit the scope of the invention.

DETAILED DESCRIPTION

In general, according to one embodiment, a predicted mean vote (PMV) estimating device calculates a PMV value from an average room radiation temperature, a room temperature, a room humidity, a room air velocity, an amount of cloth worn by a person in the room, and an amount of activity of the person in the room. The PMV estimating device comprises: an indoor solar radiation calculator; a solar radiated article temperature estimator; and an average radiation temperature estimator. The indoor solar radiation calculator calculates an amount of solar radiation entered into the room. The solar radiated article temperature estimator estimates a temperature of a solar radiated article receiving the solar radiation entered into the room, by using the amount of solar radiation entered into the room calculated by the indoor solar radiation calculator. The average radiation temperature estimator estimates the average room radiation temperature by using the temperature of the solar radiated article estimated by the solar radiated article temperature estimator.

In order to estimate a PMV, it is necessary to understand total of six factors, which are: an amount of activity and an amount of worn cloth as human factors; and a temperature, a humidity, an average radiation temperature, and an air velocity as environmental factors. The average radiation temperature is a surface temperature of a virtual closed space at a uniform temperature, which exchanges the same amount of heat radiation as the amount of heat radiation exchanged between the person in the room and the surrounding environment. The average radiation temperature is calculated by using a surface temperature of a wall or a sealing around the person in the room. In a first embodiment, the PMV is estimated by a PMV estimating device including the following configurations.

Figure 1:
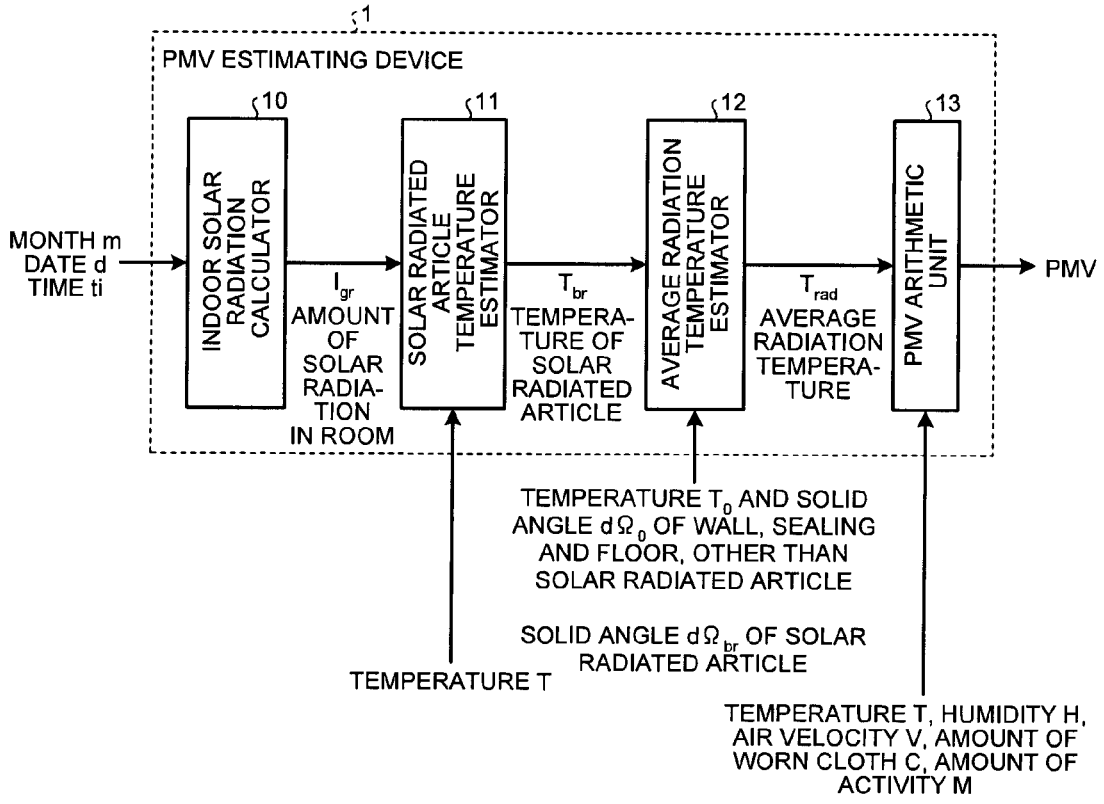
FIG. 1 is a functional block diagram of a predicted mean vote (PMV) estimating device according to a first embodiment.

As illustrated in FIG. 1, a PMV estimating device 1 according to the first embodiment comprises: an indoor solar radiation calculator 10; a solar radiated article temperature estimator 11; an average radiation temperature estimator 12; and a PMV arithmetic unit 13. The indoor solar radiation calculator 10 calculates an amount of solar radiation entered into the room through a window (or a window glass). The solar radiated article temperature estimator 11 estimates a temperature of a solar radiated article, such as a blind or a drape, due to the amount of solar radiation in the room acquired by the indoor solar radiation calculator 10. The average radiation temperature estimator 12 estimates the average radiation temperature by using the solar radiated article temperature acquired by the solar radiated article temperature estimator 11 and temperatures of a wall, a sealing and a floor other than the solar radiated article. The PMV arithmetic unit 13 estimates a PMV from the average radiation temperature acquired by the average radiation temperature estimator 12 and from a room temperature and humidity, an air velocity, an amount of worn cloth, and an amount of activity. In the following, it is assumed that the solar radiation is entered into the room through the window glass. Further, an article placed at a window side (near window), such as mainly a blind or a drape, is assumed to be the solar radiated article; however, it is not so limited.

Figure 2:
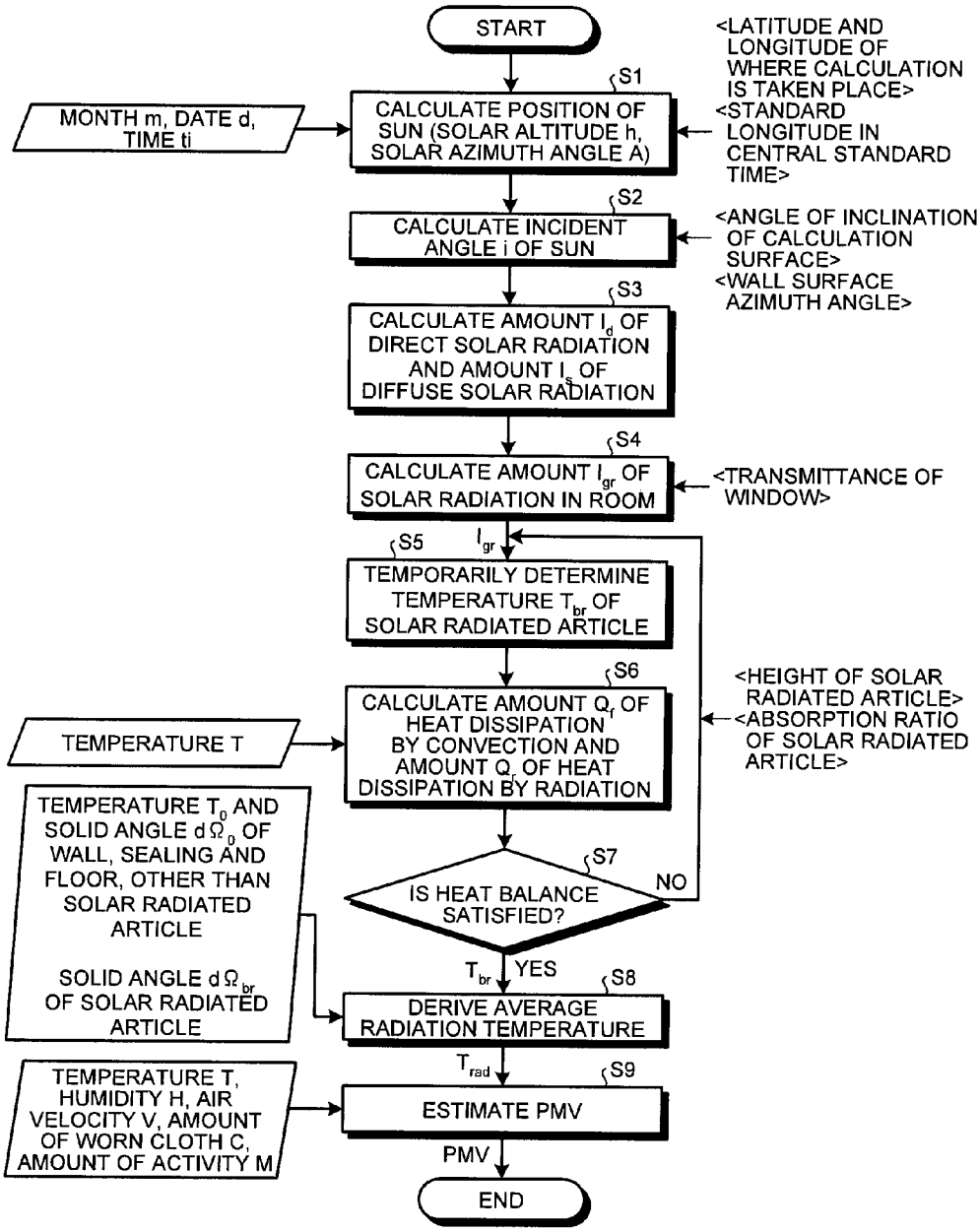
FIG. 2 is a flowchart of operations of the PMV estimating device in the first embodiment.

Detailed operations of each unit are explained with reference to a flowchart of FIG. 2. The left hand side column of FIG. 2 represents input parameters required for the PMV estimation. The right hand side column of FIG. 2 represents setting parameters unique to a building. Here, the recitations of the right hand side column are each placed between angle brackets.

The indoor solar radiation calculator 10 performs a sequence of operations from S1 to S4 illustrated in FIG. 2. At S1, a position of the sun is calculated based on current date d, current month m, and current time ti. For example, the position of the sun is defined by a solar altitude h [deg.] and a solar azimuth angle A [deg.] as illustrated in following Equations (1) and (2).

$$\sin h = \sin\left(\frac{\varphi}{180}\cdot\pi\right)\cdot\sin\left(\frac{\delta(m,d)}{180}\cdot\pi\right) + \cos\left(\frac{\varphi}{180}\cdot\pi\right)\cdot\cos\left(\frac{\delta(m,d)}{180}\cdot\pi\right)\cdot\cos\left(\frac{t(m,d,ti)}{180}\cdot\pi\right) \tag{1}$$

$$\cos A = \frac{\left[\sin\left(\frac{h}{180}\cdot\pi\right)\cdot\sin\left(\frac{\varphi}{180}\cdot\pi\right) - \sin\left(\frac{\delta(m,d)}{180}\cdot\pi\right)\right]}{\cos\left(\frac{h}{180}\cdot\pi\right)\cdot\cos\left(\frac{\varphi}{180}\cdot\pi\right)} \tag{2}$$

In the above equations, $\phi$ represents a latitude [deg.] of where the calculation is taken place, $\delta$ represents a declination [deg.] of the sun, and t represents an hour angle [deg.]. The declination $\delta$ of the sun is represented as function of day of year (1 for January 1st and 365 for December 31st), and can be calculated from the current month d and the date d. Further, the hour angle t is calculated from the current time ti, an equation of time (which is function of the day of year, and can be calculated from the current month m and the date d), a longitude of where the calculation is taken place, and a standard longitude of the central standard time (regarding the declination of the sun and the hour angle, see for example ""Journal of the Society of Heating, Air-Conditioning and Sanitary Engineers of Japan, Title II, Air-Conditioning Facility", 11$^{th}$ Edition, the Society of Heating, Air-Conditioning and Sanitary Engineers of Japan, p. 68"). Then, by using the position of the sun obtained as mentioned above, an incident angle i [deg.] of the sun by following Equation (3). In the following equation, $\theta$ represents an inclination angle [deg.] of a calculation surface (window surface) from a horizontal plane, and $\alpha$ represents a wall azimuth angle [deg.].

$$\cos i = \sin\left(\frac{h}{180}\cdot\pi\right)\cdot\cos\left(\frac{\theta}{180}\cdot\pi\right) + \cos\left(\frac{h}{180}\cdot\pi\right)\cdot\sin\left(\frac{\theta}{180}\cdot\pi\right)\cdot\cos\left(\frac{A-\alpha}{180}\cdot\pi\right) \tag{3}$$

Next, at S3, an amount $I_s$ [kcal/m$^2$·h] of diffuse solar radiation and an amount $I_d$ [kcal/m$^2$·h] of direct solar radiation at a plane of calculation are derived by using the aforementioned incident angle i of the sun.

$$I_d = \left(I_0 \times P^{\frac{1}{\sin h}}\right)\times\cos i \tag{4}$$

$$I_s = \left[1+\cos\left(\frac{\theta}{180}\cdot\pi\right)\right]\Big/2\times I_{sky} \tag{5}$$

Here, $I_0$ represents a sun multiplier (an amount of outer space direct solar radiation), $I_{sky}$ represents an amount of horizontal diffuse solar radiation, and P represents an atmospheric transmittance. $I_{sky}$ can be calculated by using following Equation (6).

$$I_{sky} = \sin h\times\left(I_0 - I_0\cdot P^{\frac{1}{\sin h}}\right)\times (0.66-0.32\times\sin h)\times[0.5+(0.4-0.3\cdot P)\times\sin h] \tag{6}$$

Next, at S4, an amount $I_{gr}$ [kcal/m$^2$·h] of solar radiation in the room is calculated by following Equation (7).

$$I_{gr} = [I_d\times CI_d(i)\times\tau_W] + (I_s\times C_d\times\tau_W) \tag{7}$$

In the above equation, $Ci_d$ represents a transmittance ratio of a standard glass by incident angles, and is function of the incident angle i of the sun (1 if the incident angle i=0 [deg.]). Further, $C_d$ represents a transmittance ratio of diffuse solar radiation at its vertical incidence, and $\tau_W$ represents a transmittance of the glass with respect to the solar radiation at its vertical incidence. The amount of the solar radiation in the room, which is entered into the room via the window glass, can be calculated by the aforementioned operations.

Next, the solar radiated article temperature estimator 11 performs a sequence of operations from S5 to S7.

At S5, a temperature $T_{br}$ [° C.] of the solar radiated article such as a blind or a drape is temporarily determined. Then, at S6, an amount of heat dissipation via convection and an amount of heat dissipation via radiation are calculated. The amount $Q_f$ [kcal/m$^2$] of heat dissipation via convection can be calculated by following Equation (8), while assuming heat-transfer by natural convection at vertical plate.

$$Q_f = \left(Nu(T_{br}, T, H_{br}) \times \frac{\lambda(T)}{H_{br}}\right) \times (T_{br} - T) \times 2 \quad (8)$$

In the aforementioned equation, Nu represents an average Nusselt number, which can be obtained from, for example, the temperature $T_{br}$ [° C.] of the solar radiated article (temperature of the heated body), the room temperature T [° C.], and the height $H_{br}$ [m] of the solar radiated article (regarding Nusselt number, see for example ""Journal of the Society of Heating, Air-Conditioning and Sanitary Engineers of Japan, Title I, Basic", 11$^{th}$ Edition, the Society of Heating, Air-Conditioning and Sanitary Engineers of Japan, p. 171". Further, λ represents a heat conductivity [kcal/(m·k)], and it is function of a room temperature T (regarding the heat conductivity, see for example "Heat Transfer", 3$^{rd}$ Edition, the Japan Society of Mechanical Engineers, p. 300)). On the other hand, the amount $Q_r$ [kcal/m$^2$] of heat dissipation by radiation is for example calculated by following equation (9). Here, σ represents Stefan-Boltzmann constant [W/(m$^2$·K$^4$)], and $\epsilon_{br}$ represents radiation ratio (absorption ratio) of the solar radiated article.

$$Q_r = \sigma \times \varepsilon_{br} \times \frac{(273.15 + T_{br})^4 - (273.15 + T)^4}{4186.8} \quad (9)$$

From above, at S7, a heat balance equation of the solar radiated article can be formulated as in following Equation (10).

$$\frac{I_{gr} \times \varepsilon_{br}}{3600} - (Q_f + Q_r) = 0 \quad (10)$$

By repeatedly calculating the temperature $T_{br}$ [° C.] of the solar radiated article that satisfies the equation (10), the temperature of the solar radiated article, such as the blind or the drape, can be estimated.

The average radiation temperature estimator 12 derives an average radiation temperature $T_{rad}$ [° C.] at a point where the PMV is to be estimated, by using the temperature $T_{br}$ of the solar radiated article estimated as described above. The average radiation temperature $T_{rad}$ [° C.] can be calculated by following equation (11), where $d\Omega_{br}$ represents a solid angle [sr] of the solar radiated article as viewed from the point where the PMV is to be estimated, $d\Omega_0$ represents a solid angle [sr] of each surfaces in the room (wall surface, sealing surface, and the floor surface) other than the solar radiated article as viewed from the point where the PMV is to be estimated, and $T_0$ represents a temperature [° C.] of the each surface in the room (S8).

$$T_{rad} = \left[\frac{d\Omega_{br} \cdot (T_{br} + 273.15)^4 + d\Omega_0 \cdot (T_0 + 273.15)^4}{4\pi}\right]^{\frac{1}{4}} - 273.15 \quad (11)$$

At last, the PMV arithmetic unit 13 estimates a current PMV by a known PMV mathematical formula or its regression formula, by using the estimated average radiation temperature $T_{rad}$ [° C.], and a measured or set room temperature T [° C.], a measured or set room humidity H [%], a measured or set room air velocity V [m/s], a measured or set amount C [clo] of worn cloth of a person in the room, and a measured or set amount M [met] of the activity (S9).

Figure 3:
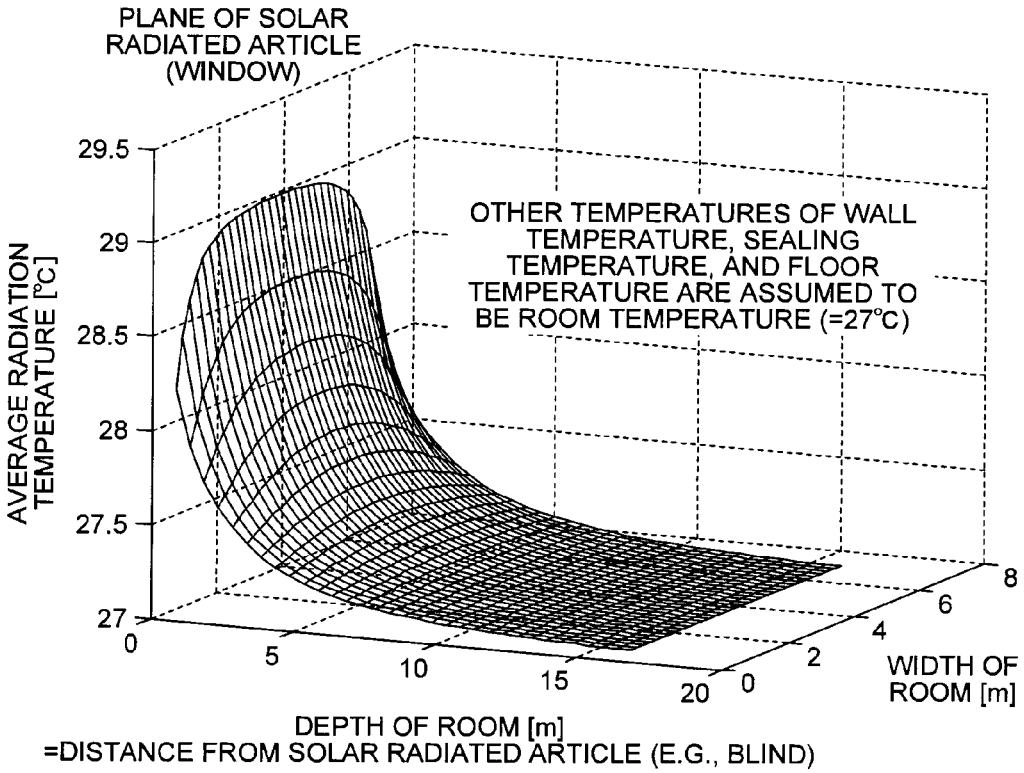
FIG. 3 is a graph illustrating a distribution of an average radiation temperature estimated by the PMV estimating device, in the first embodiment.

FIG. 3 illustrates an example of a result of the calculation of the average radiation temperature of the room estimated as described above. It can be recognized from FIG. 3 that the average radiation temperature is high at a point near the solar radiated article, and that the average radiation temperature gradually decreases as the distance from the solar radiated article (depth of the room) increases. That is to say, the result of the aforementioned calculation represents a distribution of the average radiation temperature which takes into account the influence of the temperature of the solar radiated article, such as the blind or the drape, heated by the solar radiation. As described above, according to the PMV estimating device of the present embodiment, the average radiation temperature can be estimated by taking into account the influence of the solar radiated article heated by the solar radiation entered into the room. Further, by deriving the average radiation temperature by using the solid angle of the solar radiated article as viewed from the point where the PMV is to be estimated or by using the solid angle of the each surfaces of the room as viewed from the point where the PMV is to be estimated, the PMV at an arbitrary point in a room can be estimated correctly while taking into account the influence of the solar radiated article near the window. Still further, a practical PMV can be estimated correctly with minimum number of sensors.

A PMV estimating device according to a second embodiment is configured so as to be capable of correctly estimating a PMV in accordance with a change in weather, by detecting a momentarily changing amount of solar radiation, by calculating a temperature of the solar radiated article in accordance with the detected amount of the solar radiation, and by estimating the average radiation temperature. In the present embodiment, the estimation of the PMV is performed by the PMV estimating device having the following configurations.

Figure 4:
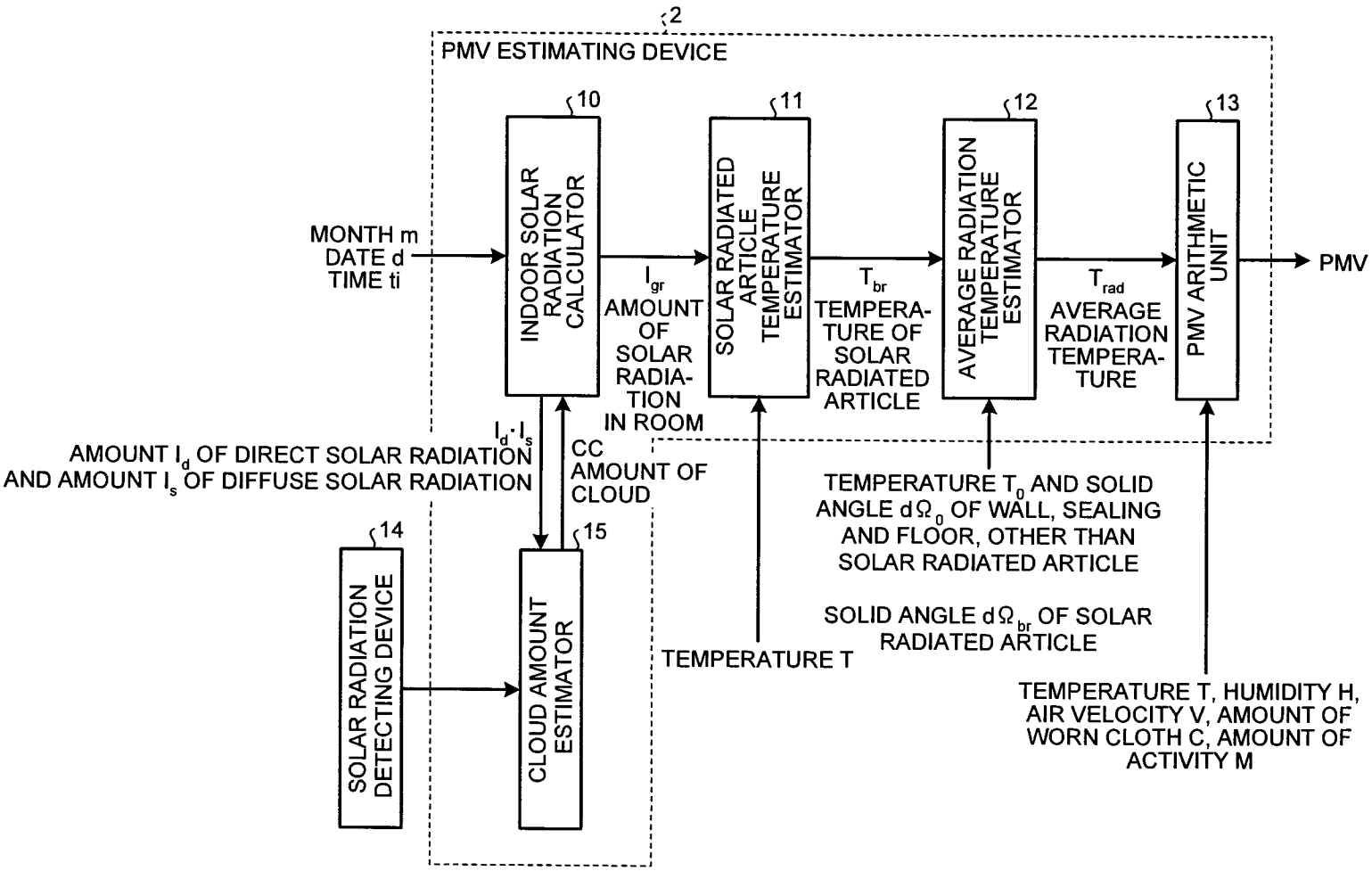
FIG. 4 is a functional block diagram of a PMV estimating device according to a second embodiment.

FIG. 4 is a functional block diagram of the PMV estimating device according to the second embodiment. In FIG. 4, the same configurations as that of the PMV estimating device of the aforementioned first embodiment illustrated in FIG. 1 are denoted by the same reference numerals, and explanations thereof are to be omitted.

As illustrated in FIG. 4, a PMV estimating device 2 of the present embodiment includes: a solar radiation detecting device 14 that detects an amount of solar radiation; and a cloud amount estimator that estimates an amount of clouds from the amount of solar radiation detected by the solar radiation detecting device 14, to simulate a condition in which the solar radiation is blocked in accordance with weather.

Figure 5:
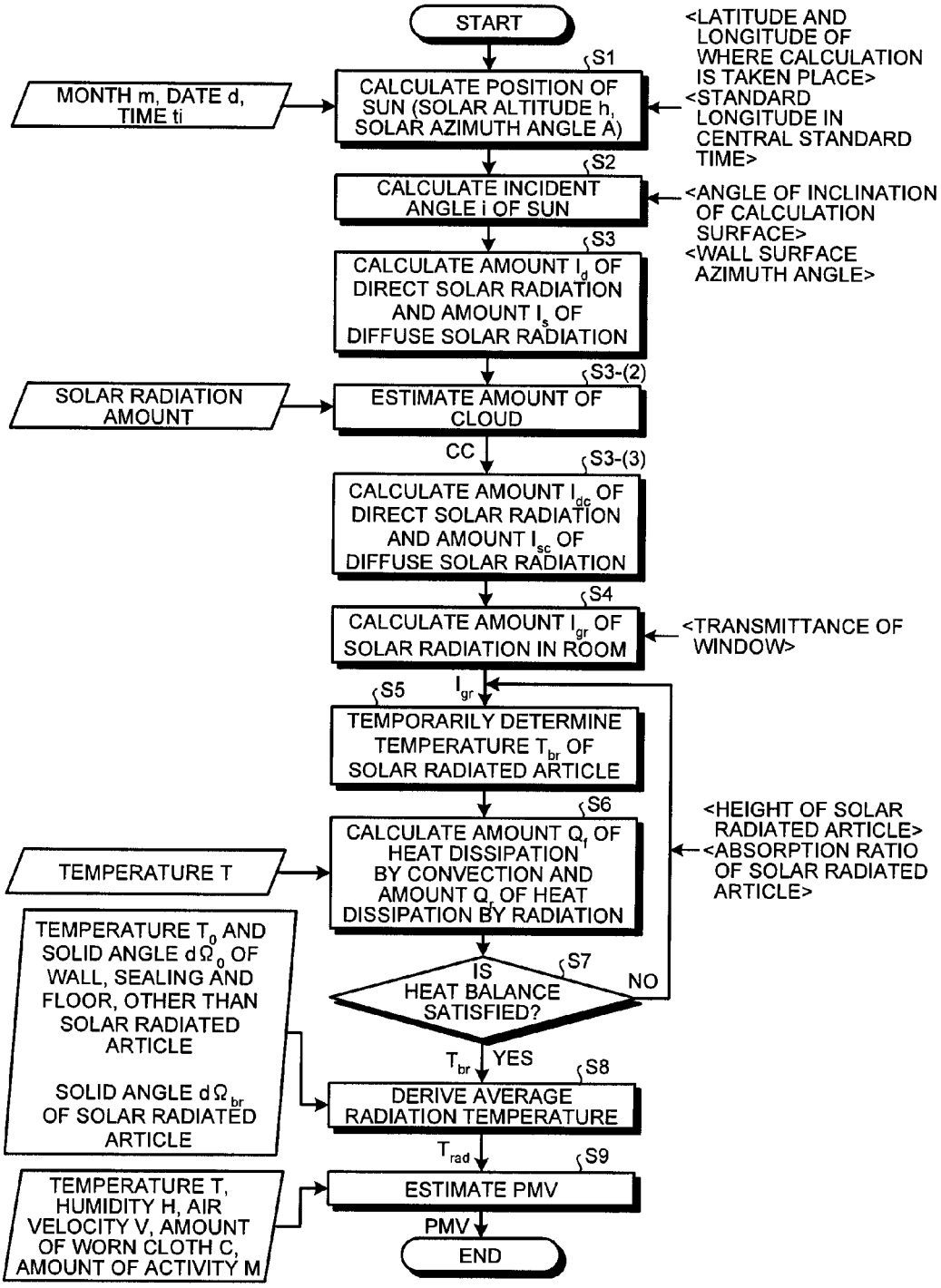
FIG. 5 is a flowchart of operations of the PMV estimating device in the second embodiment.

Next, operations of the PMV estimating device of the present embodiment is explained with reference to a flowchart of FIG. 5. The left hand side column of FIG. 5 represents input parameters required for a sequence of operations of PMV estimation, and the right hand side column in FIG. 5 represents quasi-fixed setting parameters. Here, the recitations of the right hand side column are each placed between angle brackets. S3-(2) and S3-(3) are the only difference from FIG. 2 illustrating the operation flow of the aforementioned first embodiment.

At S3, the amount $I_d$ [kcal/m$^2$·h] of direct solar radiation and the amount $I_s$ [kcal/m$^2$·h] of diffuse solar radiation are derived by using the incident angle i of the sun (see Equations (4) and (5)). However, the amount of the solar radiation changes largely due to momentarily changing weather. Factors for such change are, blockage of the solar radiation by clouds, and changes in an atmospheric transmittance due to changes in temperature and humidity. Thus, there is introduced an amount CC of clouds, which is a correction coefficient for estimating an amount of solar radiation decreased due to the aforementioned weather. Accordingly, at S3-(2), the cloud amount estimator 15 estimates the amount of clouds which differs by weather condition. Here, the amount CC of clouds is assumed to be a dimensionless quantity of an arbitrarily value between 0 to 10. An amount $I_{dc}$ [kcal/m$^2$·h] of direct solar radiation and an amount $I_{sc}$ [kcal/m$^2$·h] of diffuse solar radiation, which take into account the aforementioned weather condition, are expressed by following Equations (12) and (13).

$$I_{dc} = \left(1 - \text{coef_CC} \cdot \frac{CC}{10}\right) \times \left(I_0 \cdot P^{\frac{1}{\sin h}} \cdot \cos i\right) \tag{12}$$

$$I_{sc} = \left(1 - \text{coef_CC} \cdot \frac{CC}{10}\right) \times \left[1 + \cos\left(\frac{\theta}{180} \cdot \pi\right)\right] \times \frac{I_{sky}}{2} \tag{13}$$

As the solar radiation detecting device 14, a solar radiation sensor horizontally placed at a rooftop is assumed. θ=0 [deg.] and the incident angle i [deg.] of the sun thereof, obtained by Equation (3), are substituted into Equations (12) and (13). Then, the amount of clouds can be estimated by deriving a value of CC satisfying, for example, following Equation (14).

$$CC = \left(10 - \frac{\text{amount of solar radiation measured by solar radiation detecting device}}{I_{de} + I_{sc}} \times 10\right) \tag{14}$$

In equations (12) and (13), coef_CC is a parameter of a degree of influence of the amount of clouds, and can be set to an arbitrarily value in accordance with conditions. By using the amount CC of clouds estimated as mentioned above, the amount $I_{dc}$ [kcal/m$^2$·h] of direct solar radiation and the amount $I_{sc}$ [kcal/m$^2$·h] of diffuse solar radiation at each window surface where the solar radiated article is placed are obtained by Equations (12) and (13) at S3(3), while taking into account the weather condition. The subsequent operations are the same as that of the operation flow of the first embodiment as illustrated in FIG. 2, thereby the explanations thereof are omitted.

According to the above described PMV estimating device of the present embodiment, it becomes possible to estimate the temperature of the solar radiated article, such as a blind or a drape, while taking into account the change in the amount of the solar radiation due to the weather condition. Further, by evaluating the average radiation temperature using the estimated temperature, it becomes possible to correctly estimate the PMV corresponding to the momentarily changing solar radiation environment.

In comparison to the above second embodiment, a PMV estimating device of a third embodiment uses a solar power generator as the solar radiation detecting device.

Figure 6:
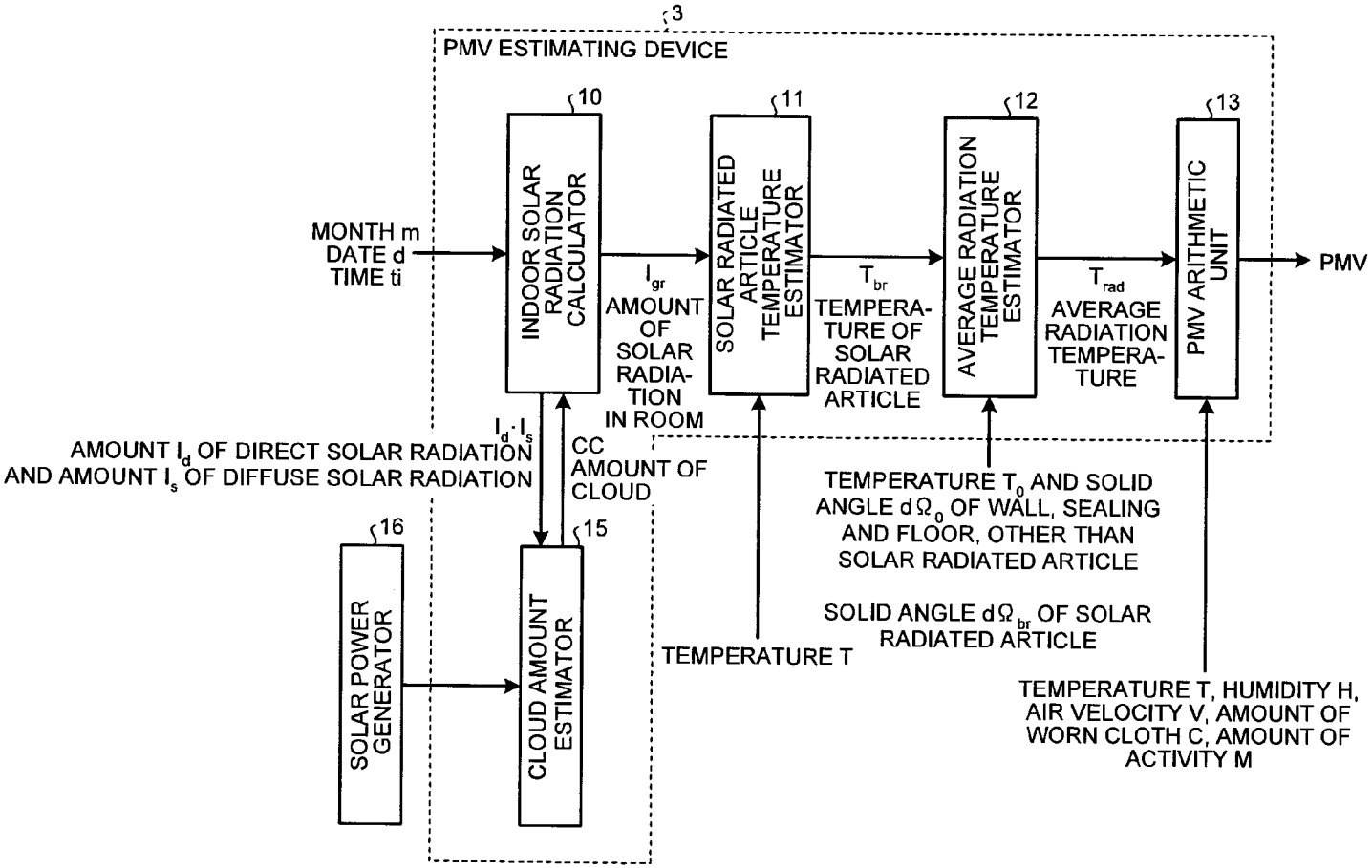
FIG. 6 is a functional block diagram of a PMV estimating device according to a third embodiment.

FIG. 6 is a functional block diagram of the PMV estimating device according to the third embodiment. In FIG. 6, the same configurations as that of the PMV estimating device of the aforementioned second embodiment are denoted by the same reference numerals, and the explanations thereof are omitted.

Figure 7:
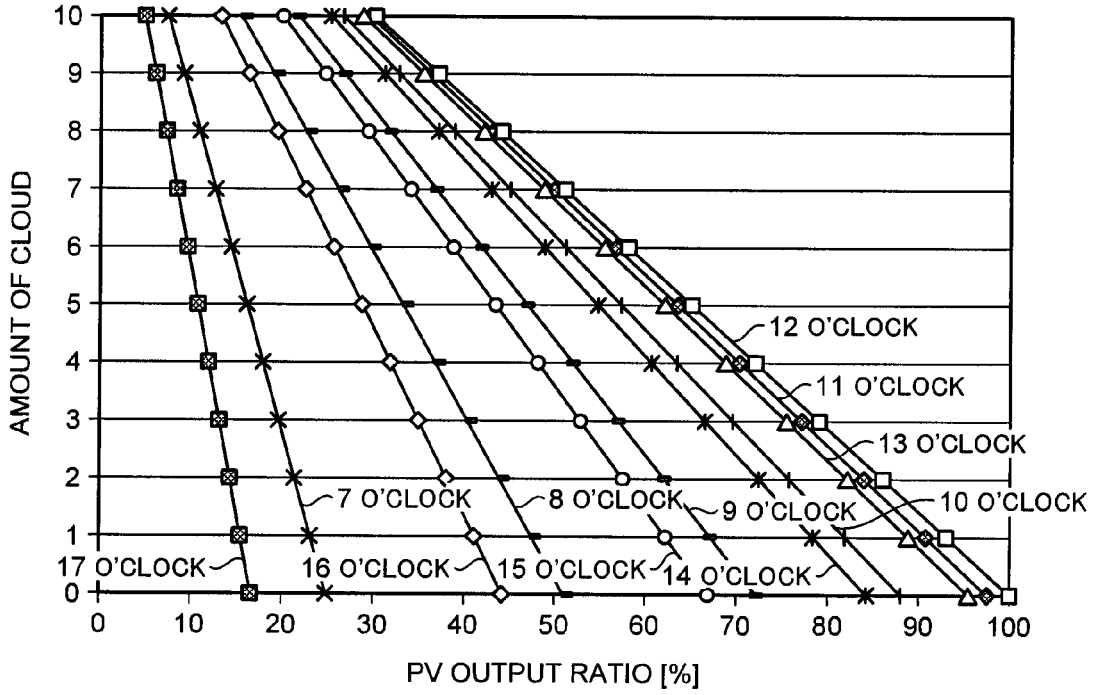
FIG. 7 is a graph illustrating a relationship between a PV output ratio and an amount of clouds (e.g., that of March in West Tokyo) in the PMV estimating device in the third embodiment.

In a PMV estimating device 3 of the present embodiment, the cloud amount estimator 15 is configured to preliminarily hold a relational expression or a correspondence table between an amount of clouds and a ratio of power generation of a solar power generator 16, as illustrated in FIG. 7, in accordance with a characteristic, location, season, time, and/or the like of the solar power generator 16 as the solar radiation detecting device. The cloud amount estimator 15 can estimate the amount of clouds from the momentarily changing amount of electricity generated by solar power based on the relational expression or the correspondence table.

Operations of the PMV estimating device 3 of the present embodiment are same as that of the PMV estimating device 2 of the aforementioned second embodiment, except that the amount of clouds is estimated based on the relational expression or the correspondence table between the amount of clouds and the ratio of power generation (ratio with respect to the maximum amount of generated electricity on sunny day by each season) of the solar power generator 16.

According to the PMV estimating device of the present embodiment, by utilizing the solar power generator 16, which has recently been widely introduced, as the solar radiation detecting device, it becomes unnecessary to install an additional equipment for detecting the amount of solar radiation. Accordingly, cost can be reduced as well as effort for the maintenance and the management can be saved.

A PMV estimating device of a fourth embodiment is configured so as to be able to correctly estimate a PMV at an arbitrary point in the room while taking into account the influence of changes in temperature of the solar radiated article by the window, by introducing an average radiation temperature using a solid angle corresponding to a relative positional relationship between the point where the PMV is to be estimated and the window or the wall. In the present embodiment, the PMV is estimated by a PMV estimating device having the following configurations.

Figure 8:
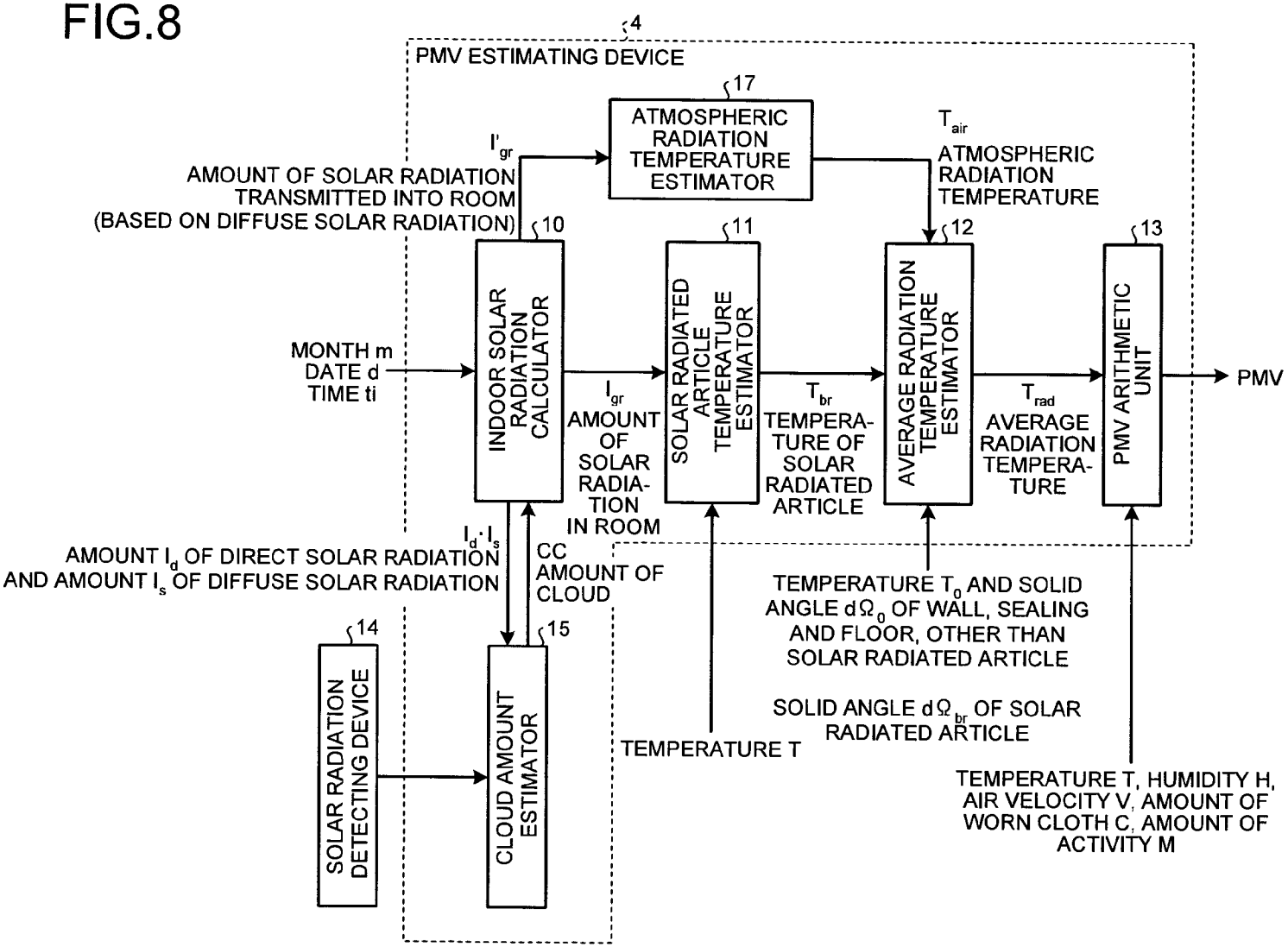
FIG. 8 is a functional block diagram of a PMV estimating device according to a fourth embodiment.

FIG. 8 is a functional block diagram of the PMV estimating device according to the fourth embodiment. In FIG. 8, the same configurations as that of the PMV estimating device of the aforementioned second embodiment illustrated in FIG. 4 are denoted by the same reference numerals, and the explanations thereof are to be omitted.

The PMV estimating device 4 of the present embodiment additionally comprise an atmospheric radiation temperature estimator 17. The atmospheric radiation temperature estimator 17 estimates an atmospheric radiation temperature from an amount of solar radiation in the room due to the diffuse solar radiation, from among the amount of solar radiation calculated by the indoor solar radiation calculator 10. Accordingly, the PMV estimating device 4 estimates a practical average radiation temperature, even in a case when the window side of a blind, a drape, and/or the like are not entirely covered by the solar radiated article. In order to construct the present embodiment, it is assumed that there is no direct solar radiation from an opening at the window side. This is because it is often the case that, if there exists direct solar radiation, a person in the room normally blocks the direct solar radiation by moving the solar radiated article, such as a blind or a drape, and adjusting a degree of opening of the window.

Figure 9:
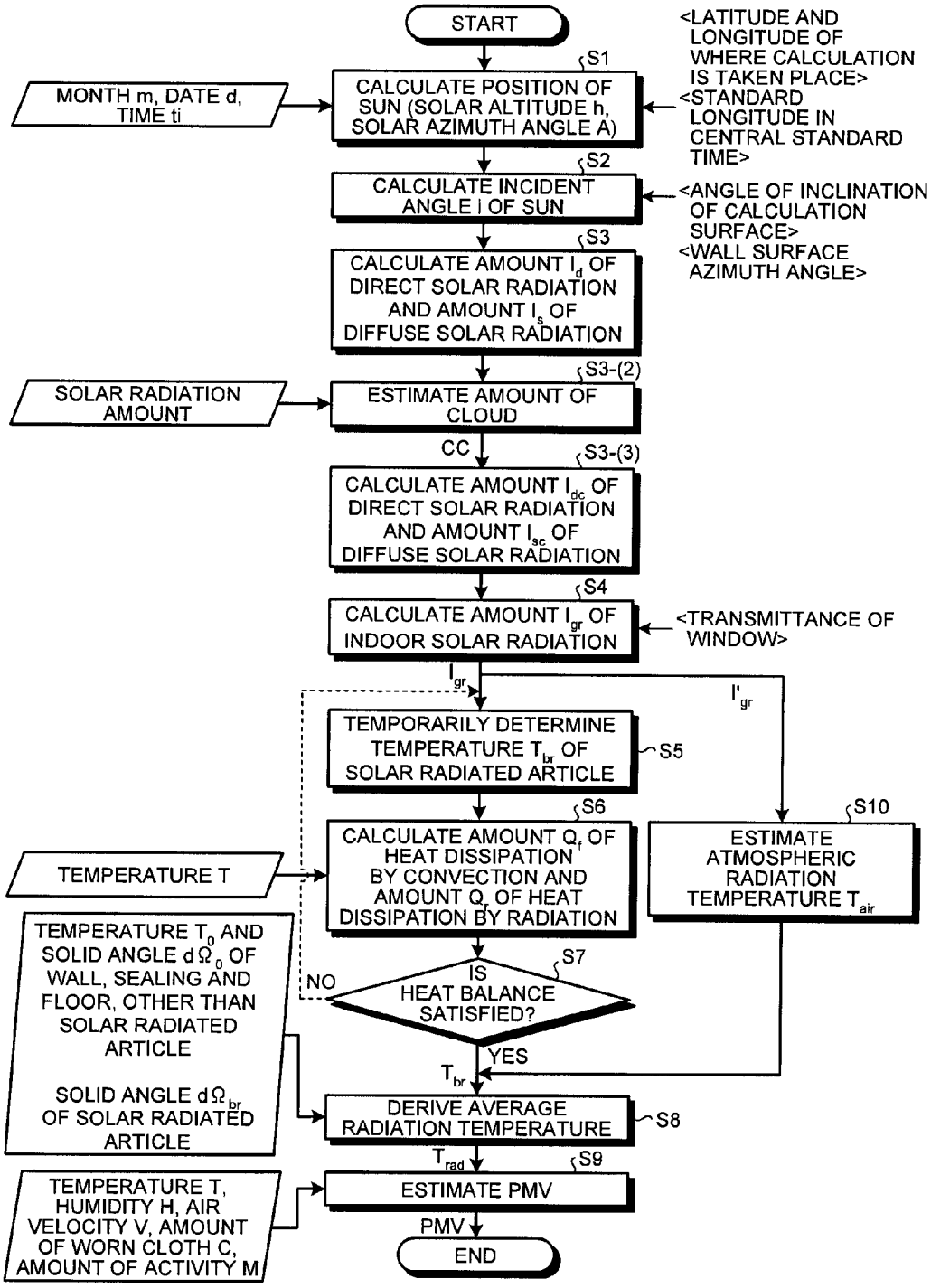
FIG. 9 is a flowchart of operations of the PMV estimating device in the fourth embodiment.

Operations of the PMV estimating device of the present embodiment is explained with reference to the flowchart of FIG. 9. The difference from FIG. 5, which is the operation flow of the aforementioned second embodiment, is that S10 is added.

At S4, the indoor solar radiation calculator 10 derives the amount $I'_{gr}$ [kcal/m$^2$·h] of solar radiation in the room due to diffuse solar radiation by following Equation (15).

$$I'_{gr} = I_s \times C_d \times \tau_W \tag{15}$$

Here, $I_s$ represents an amount [kcal/m$^2$·h] of diffuse solar radiation, and calculated by Equation (15). Further, $C_d$ represents a transmittance ratio with respect to diffuse solar radiation when its incident angle is vertical, and $\tau_W$ represents a transmittance of a glass at the time of vertical incidence.

Next, at S10, the atmospheric radiation temperature estimator 17 estimates an atmospheric radiation temperature $T_{air}$ [° C.] by using the amount $I'_{gr}$ of the solar radiation in the room due to the aforementioned diffuse solar radiation. This is estimated by using a relational expression or a correspondence table between an amount of solar radiation in the room due to the diffuse solar radiation preliminarily measured at, for example, a building surface facing the North where there is not direct solar radiation and an atmospheric radiation temperature at this measurement.

Then, at S8, an average radiation temperature $T_{rad}$ [° C.] at the point where the PMV is to be estimated is derived by following Equation (16), by using the atmospheric radiation temperature $T_{air}$ obtained as mentioned above.

$$T_{rad} = \left[ \frac{(d\Omega_{br} - d\Omega'_{br}) \cdot (T_{br} + 273.15)^4 + d\Omega'_{br} \cdot (T_{air} + 273.15) + d\Omega_0 \cdot (T_0 + 273.15)^4}{4\pi} \right]^{\frac{1}{4}} - 273.15 \quad (16)$$

Here, $d\Omega_{br}$ represents a solid angle [sr] of the solar radiated angle as viewed from the point where the PMV is to be estimated; $d\Omega'_{br}$ represents a solid angle [sr] of an opening of the solar radiated article as viewed from the point where the PMV is to be estimated; $d\Omega_0$ represents a solid angle [sr] of each surface in the room other than the solar radiated article, as viewed from the point where the PMV is to be estimated; $T_{br}$ represents a temperature of the solar radiated article; and $T_0$ represents a temperature [° C.] of each surface in the room other than the solar radiated article.

$d\Omega'_{br}$ is calculated by following Equation (17) by using a coefficient $\alpha$ (e.g., 0 when fully closed and 1 when fully opened), which represents a degree of opening of the solar radiated article such as a blind or a drape, with respect to the solid angle $d\Omega_{br}$ of the solar radiated article as viewed from the point where the PMV is to be estimated.

$$d\Omega'_{br} = d\Omega_{br} \times \alpha \quad (17)$$

Other operations are the same as that of the operation flow of the second embodiment illustrated in FIG. 5, thereby the explanations thereof are omitted.

According to the PMV estimating device of the present embodiment described above, even if the solar radiated article such as a blind or a drape is not fully closed, an average radiation temperature and a PMV that match the actual practice can be estimated. In the above, additional functions, operations, and effects specific to the present embodiment are explained over the configuration of the second embodiment; however, the additional functions specific to the present embodiment may be applied to the aforementioned first embodiment or the third embodiment.

A PMV estimating device of a fifth embodiment is configured so as to be able to correctly estimate a PMV at an arbitrary point in the room while taking into account heat transfer with respect to an outside air via a window and transfer of radiation energy between inside and outside of the room except for that of the solar radiation. In the present embodiment, the PMV is estimated by a PMV estimating device having the following configurations.

Figure 10:
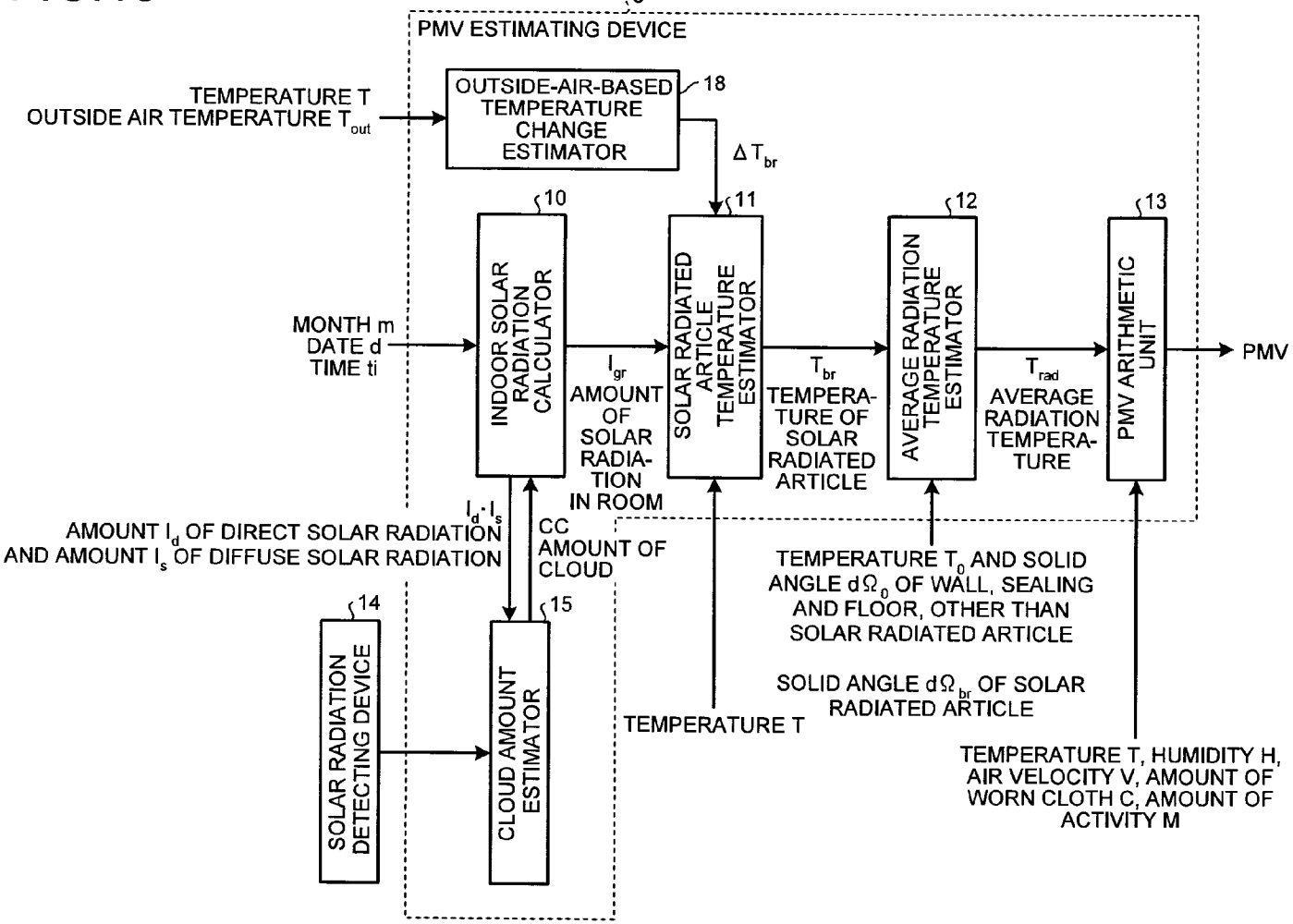
FIG. 10 is a functional block diagram of a PMV estimating device according to a fifth embodiment.

FIG. 10 is a functional block diagram of the PMV estimating device according to the fifth embodiment. In FIG. 10, the same configurations as that of the PMV estimating device of the aforementioned second embodiment illustrated in FIG. 4 are denoted by the same reference numerals, and the explanations thereof are omitted.

In comparison to the PMV estimating device 2 of the second embodiment, PMV estimating device 5 of the present embodiment is further provided with an outside-air-based temperature change estimator that estimates change in temperature of a solar radiated article such as a blind or a drape due to the influence of the heat transfer with respect to the outside air via the window or the transfer of the radiation energy between inside and outside the room except for that of the solar radiation.

Figure 11A:
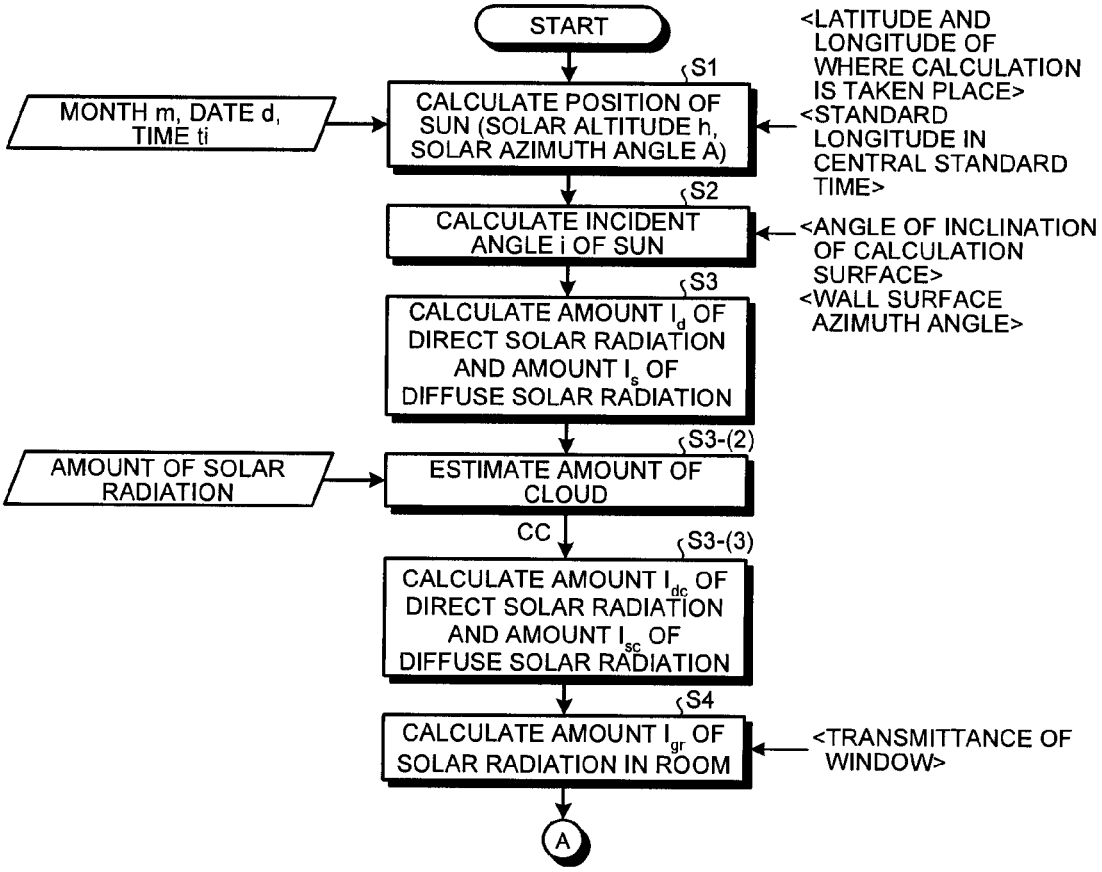
FIGS. 11A and 11B are flowcharts of operations of the PMV estimating device in the fifth embodiment.
Figure 11B:
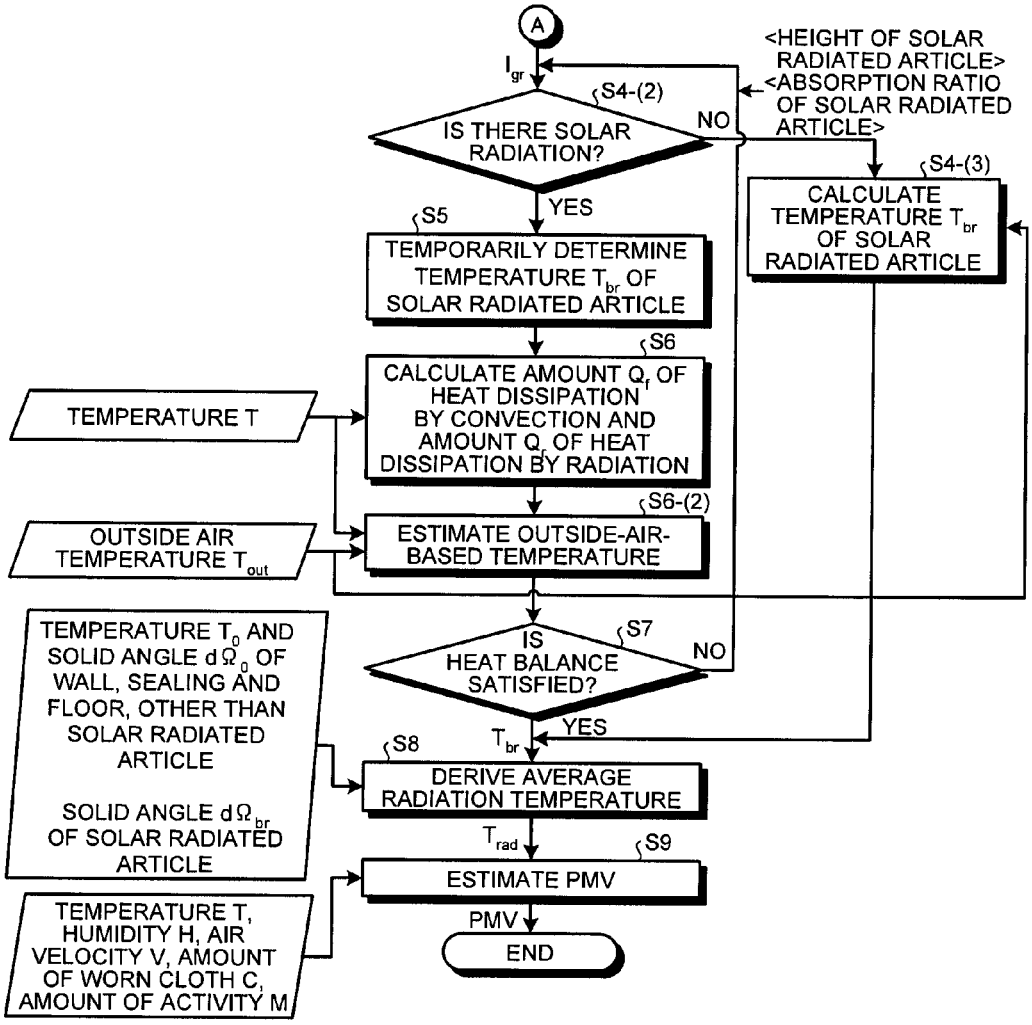

Next, operations of the PMV estimating device of the present embodiment are explained with reference to the flowchart of FIG. 11. Differences from the operation flow of the aforementioned second embodiment illustrated in FIG. 5 are S4-(2), S4-(3), and S6-(2).

In the present embodiment, at S4-(2), it is determined whether there exists solar radiation. If it is determined that there exists solar radiation (Yes at S4-(2)), the process moves to S5 and the subsequent steps. If it is determined that there exists no solar radiation (No at S4-(2)), the temperature $T_{br}$ of the solar radiated article is calculated, at S4-(3), similarly as described above, and the process moves to S8.

At S6-(2), the outside-air-based temperature change estimator 18 estimates change in temperature $\Delta T_{br}$ [° C.] of the solar radiated article such as the blind or the drape due to the influence of the heat transfer with respect to the outside air via the window or the transfer of the radiation energy between inside and outside the room.

The change in temperature $\Delta T_{br}$ [° C.] of the solar radiated article is estimated by a relational expression based on an outside air temperature, a room temperature, and a temperature of the solar radiated article, measured during the night when there exists no solar radiation. That is to say, it is derived how much the temperature of the solar radiated article change from the room temperature, in accordance with the difference between the outside air temperature and the room temperature, by for example following relational Equation (18).

$$\Delta T_{br} = K \cdot (T_{out} - T) \quad (18)$$

In the aforementioned equation, K represents a proportional constant, and set based on the outside air temperature, the room temperature, and the temperature of the solar radiated article measured at night when there exists no solar radiation.

Next, at S7, the temperature $T_{br}$ [° C.] of the solar radiated article such as the blind or the drape is estimated by using the aforementioned change in temperature $\Delta T_{br}$ of the solar radiated article. The method for estimating the temperature of the solar radiated article changes depends of whether the solar radiation exists. If there exists solar radiation, the temperature $\Delta T_{br}$ [° C.] of the solar radiated article is estimated so that a heat balance equation of the solar radiated article illustrated in following Equation (19) is satisfied.

$$\frac{I_{gr} \times \varepsilon_{br}}{3600} - (Q_f(T_{br}) + Q_r(T_{br}) + \Delta T_{br} \cdot C_{br}) = 0 \quad (19)$$

Here, $C_{br}$ represents a specific heat of the solar radiated article, such as a blind or a drape. On the other hand, if there exists no solar radiation, the temperature $\Delta T_{br}$ [° C.] of the solar radiated article is calculated by following equation (20).

$$T_{br} = T + \Delta T_{br} \quad (20)$$

Other operations are the same as that of the operation flow of the second embodiment as illustrated in FIG. 5, thereby the explanations thereof are omitted.

As described above, the PMV estimating device of the present embodiments estimate the temperature of the solar radiated article, such as a blind or a drape, by taking into account the influence of the heat transfer with respect to the outside air via a window or the transfer of the radiation energy between inside and outside of the room except for that of the solar radiation. Thus, it becomes capable to estimate a practical temperature of the solar radiated article and a practical average radiation temperature, especially in the night time or in winter when there is a large temperature difference between indoor and outdoor. Therefore, it becomes possible to correctly estimate a practical PMV. Here, the additional functions, their operations and effects specific to the present embodiment are explained with respect to the configurations of the second embodiment. However, the additional functions specific to the present embodiment may be applied to the aforementioned first embodiment, the third embodiment, or the fourth embodiment.

As mentioned above, various embodiments are described. As described above, the PMV estimating device according to the first to the fifth embodiment can correctly estimate a practical PMV. The PMV estimating device of the aforementioned embodiments can be applied to an air conditioning control devices or the like for controlling the air conditioning of the buildings based on the PMV value.

Figure 12:
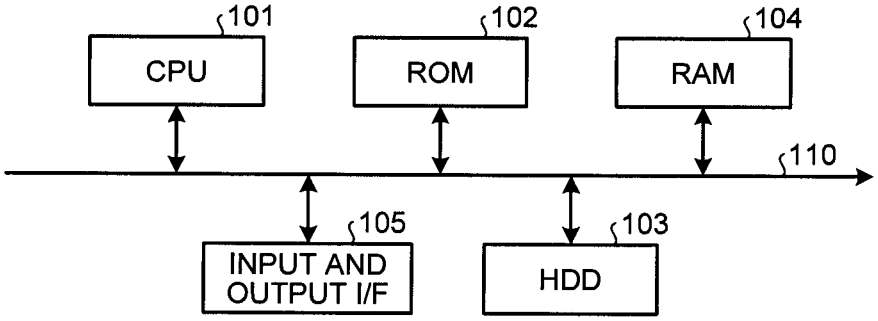
FIG. 12 is a diagram illustrating a hardware configuration common to the PMV estimating devices of the first embodiment to the fifth embodiment.

FIG. 12 illustrates a hardware configuration common to the PMV estimating devices according to the first to the fifth embodiments. As the hardware configuration, the PMV estimating device comprises: a read only memory (ROM) 102 storing an initial program such as a boot program or the like; a hard disk drive (HDD) 103 storing a processing program or the like describing an operating system (OS) or each of various aforementioned process; a random access memory 104 temporarily storing various data necessary for process by CPU 101; and an input and output interface (I/F) 105 for performing input and output of data with respect to an external device; and a bus 110 for connecting each portions thereamong.

The aforementioned processing program may be stored in a computer readable recording medium, such as a compact disk read only memory (CD-ROM), a floppy disk (FD), and/or a digital versatile disk (DVD), as a installable or executable file, and provided. Further, the aforementioned processing program may be stored on a computer connected to a network such as the Internet, and provided by being downloaded via the network.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A predicted mean vote (PMV) estimating device that calculates a PMV value from an average room radiation temperature, a room temperature, a room humidity, a room air velocity, an amount of cloth worn by a person in the room, and an amount of activity of the person in the room, the PMV estimating device comprising:

an indoor solar radiation calculator that calculates an amount of solar radiation entered into the room;

a solar radiated article temperature estimator that estimates a temperature of a solar radiated article receiving the solar radiation entered into the room, by using the amount of solar radiation entered into the room calculated by the indoor solar radiation calculator; and an average radiation temperature estimator that estimates the average room radiation temperature by using the temperature of the solar radiated article estimated by the solar radiated article temperature estimator, wherein the solar radiated article temperature estimator calculates an amount of heat dissipation, and estimates the temperature of the solar radiated article based on the amount of heat dissipation, the amount of solar radiation in the room estimated by the indoor solar radiation calculator, and an absorption ratio of the solar radiation by the solar radiated article, and the average radiation temperature estimator estimates the average room radiation temperature at an arbitrary point in the room where the PMV is to be estimated by using the temperature of the solar radiated article estimated by the solar radiated article temperature estimator, a room temperature, a solid angle of the solar radiated article as viewed from the point in the room where the PMV is to be estimated, a solid angle of a face in the room other than the solar radiated article as viewed from the point in the room where the PMV is to be estimated.

2. The predicted mean vote estimating device of claim 1, wherein the indoor solar radiation calculator estimates the amount of the solar radiation entered into the room from time, date, and month of a calculation target, from an angle of inclination of a plane of a window near a position where the solar radiated article receives the solar radiation, from an azimuth angle, and from a transmittance of the window with respect to the solar radiation, the solar radiated article temperature estimator calculates the amount of heat dissipation by convection and radiation with respect to a surrounding environment, and the average radiation temperature estimator estimates the average room radiation temperature at the point in the room where the PMV is to be estimated by using the temperature of the solar radiated article, a temperature of a wall, sealing and floor in the room other than the solar radiated article, the solid angle of the solar radiated article as viewed from the point in the room where the PMV is to be estimated, a solid angle of the wall, the sealing and the floor in the room other than the solar radiated article as viewed from the point in the room where the PMV is to be estimated.

3. A computer program product having a non-transitory computer readable medium including programmed instructions for calculating a predicted mean vote (PMV) value based on an average room radiation temperature, a room temperature, a room humidity, a room air velocity, an amount of cloth worn by a person in the room, and an amount of activity of the person in the room, wherein the instructions, when executed by a computer, cause the computer to perform:

calculating an amount of solar radiation entered into the room;

estimating a temperature of a solar radiated article receiving the solar radiation entered into the room, by using the calculated amount of solar radiation entered into the room; and estimating the average room radiation temperature by using the estimated temperature of the solar radiated article, wherein estimating the temperature of the solar radiated article includes calculating an amount of heat dissipation and estimating the temperature of the solar radiated article based on the amount of heat dissipation, the estimated amount of solar radiation in the room, and an absorption ratio of the solar radiation by the solar article, and estimating the average room radiation temperature includes estimating the average room radiation temperature at an arbitrary point in the room where the PMV is to be estimated by using the estimated temperature of the solar radiated article, a room temperature, a solid angle of the solar radiated article as viewed from the point in the room when the PMV is to be estimated, a solid angle of a face in the room other than estimated.

4. The computer program product of claim 3, wherein the calculating includes estimating the amount of the solar radiation entered into the room from time, date, and month of a calculation target, from an angle of inclination of a plane of a window near a position where the solar radiated article receives the solar radiation, from an azimuth angle, and from a transmittance of the window with respect to the solar radiation, the estimating the temperature of the solar radiated article includes:

calculating the amount of heat dissipation by convection and radiation with respect to a surrounding environment; and the estimating the average room radiation temperature includes estimating the average room radiation temperature at the point in the room where the PMV is to be estimated by using the estimated temperature of the solar radiated article, a temperature of a wall, sealing and floor in the room other than the solar radiated article, the solid angle of the solar radiated article as viewed from the point in the room where the PMV is to be estimated, a solid angle of the wall, the sealing and the floor in the room other than the solar radiated article as viewed from the point in the room where the PMV is to be estimated.

* * * * *